US008042284B2

(12) United States Patent
Yoo et al.

(10) Patent No.: US 8,042,284 B2
(45) Date of Patent: Oct. 25, 2011

(54) HEATING SYSTEM, DRYING MACHINE HAVING THE HEATING SYSTEM, AND METHOD OF CONTROLLING THE HEATING SYSTEM

(75) Inventors: Hea Kyung Yoo, Seoul (KR); Seog Ho Go, Gimhae-Si (KR)

(73) Assignee: LG Electronics Inc., Seoul (KR)

( * ) Notice: Subject to any disclaimer, the term of this patent is extended or adjusted under 35 U.S.C. 154(b) by 961 days.

(21) Appl. No.: 11/869,405

(22) Filed: Oct. 9, 2007

(65) Prior Publication Data

US 2008/0210769 A1 Sep. 4, 2008

(30) Foreign Application Priority Data

Oct. 9, 2006 (KR) ..... 10-2006-0098066

(51) Int. Cl.
*F26B 11/02* (2006.01)

(52) U.S. Cl. ..... 34/601; 34/595; 34/606; 68/20; 68/18; 208/176; 219/480; 318/60; 53/440; 53/563; 398/18; 398/86

(58) Field of Classification Search ..... 34/413, 34/497, 601, 602, 595, 606, 90, 58; 68/20, 68/18; 208/176; 219/480; 318/60; 53/440, 53/563; 399/18, 86
See application file for complete search history.

(56) References Cited

U.S. PATENT DOCUMENTS 1,695,302 A * 12/1928 Thompson ..... 219/50
1,736,420 A * 11/1929 Sundstrand ..... 431/27
1,933,901 A * 11/1933 Gannon ..... 219/480
1,950,102 A * 3/1934 Eichenbaum ..... 223/12
1,975,805 A * 10/1934 Smith ..... 99/451
1,983,539 A * 12/1934 Engstrom et al. ..... 105/37
2,009,601 A * 7/1935 Anderson ..... 368/160
2,026,530 A * 1/1936 Hager ..... 119/319
2,096,063 A * 10/1937 Reynolds ..... 53/234
2,109,469 A * 3/1938 Cohn et al. ..... 26/72
2,193,495 A * 3/1940 Rolkern ..... 8/159
2,339,030 A * 1/1944 Purkett ..... 34/131
2,349,813 A * 5/1944 Denneen et al. ..... 219/656
2,408,370 A * 10/1946 Burrill ..... 334/29
2,490,891 A * 12/1949 Walton ..... 340/870.05
2,553,581 A * 5/1951 Hatfield ..... 68/12.14
2,555,343 A * 6/1951 Jones ..... 156/366
2,578,666 A * 12/1951 Borden, Jr. ..... 89/41.02
2,597,784 A * 5/1952 Field et al. ..... 342/33
2,617,094 A * 11/1952 Tinus ..... 342/139
2,632,294 A * 3/1953 Wall ..... 60/243
2,647,945 A * 8/1953 Ridings et al. ..... 358/410
2,663,421 A * 12/1953 Reynolds et al. ..... 209/561
2,664,336 A * 12/1953 Cornell ..... 208/176
2,664,337 A * 12/1953 Cornell ..... 208/176
2,691,345 A * 10/1954 Huebner ..... 101/212

(Continued)

FOREIGN PATENT DOCUMENTS

DE 19740338 A1 * 3/1999

(Continued)

*Primary Examiner* — Stephen M. Gravini
(74) *Attorney, Agent, or Firm* — Birch, Stewart, Kolasch & Birch, LLP

(57) ABSTRACT

A heating system and a method of controlling the heating system are provided. When a heating unit and a switch are turned on and off repeatedly by the predetermined number of times or more, only some of heaters of the heating unit are turned on, thereby increasing service life of the heating unit and the switch.

5 Claims, 3 Drawing Sheets

U.S. PATENT DOCUMENTS 2,712,717 A * 7/1955 Keller ..... 53/453
2,714,842 A * 8/1955 Hooven ..... 396/553
2,716,497 A * 8/1955 Wahl et al. ..... 414/792
2,735,330 A * 2/1956 Polster ..... 356/332
2,738,382 A * 3/1956 Brooks et al. ..... 379/285
2,746,263 A * 5/1956 Polster ..... 62/71
2,781,257 A * 2/1957 Wilkins ..... 75/407
2,784,265 A * 3/1957 Weide ..... 200/5 R
2,787,428 A * 4/1957 Schuck ..... 244/183
2,798,304 A * 7/1957 Reiter ..... 34/91
2,798,306 A * 7/1957 Reiter ..... 34/609
2,820,936 A * 1/1958 Rainey ..... 318/600
2,822,933 A * 2/1958 Pagdin ..... 414/796.2
2,827,789 A * 3/1958 Oplinger et al. ..... 74/5.4
2,832,352 A * 4/1958 Powell ..... 131/84.1
2,850,232 A * 9/1958 Beck et al. ..... 708/102
RE24,584 E * 1/1959 Hooven ..... 396/553
2,870,246 A * 1/1959 Hallden et al. ..... 358/407
2,883,815 A * 4/1959 Maitino ..... 53/239
2,904,942 A * 9/1959 Avril ..... 53/440
2,909,878 A * 10/1959 Shiu ..... 53/563
2,920,471 A * 1/1960 Barros ..... 68/20
2,925,912 A * 2/1960 Clark ..... 210/108
2,938,844 A * 5/1960 Graham et al. ..... 376/358
2,939,201 A * 6/1960 Holland ..... 66/202
2,941,308 A * 6/1960 Cobb et al. ..... 34/552
2,943,788 A * 7/1960 Hearsum et al. ..... 235/431
2,945,648 A * 7/1960 Oplinger et al. ..... 244/179
3,006,176 A * 10/1961 Behrens ..... 68/12.01
3,012,839 A * 12/1961 Innes et al. ..... 347/113
3,020,128 A * 2/1962 Adcock et al. ..... 75/395
3,028,680 A * 4/1962 Conlee et al. ..... 34/145
3,030,511 A * 4/1962 Scherbatskoy ..... 250/264
3,031,158 A * 4/1962 Gille ..... 244/179
3,032,951 A * 5/1962 Mohler et al. ..... 53/141
3,046,882 A * 7/1962 Aubrey et al. ..... 101/227
3,053,449 A * 9/1962 Hoberg et al. ..... 710/67
3,066,519 A * 12/1962 Harbor et al. ..... 68/12.08
3,102,374 A * 9/1963 Lloyd et al. ..... 53/501
3,107,375 A * 10/1963 Byland et al. ..... 412/41
3,110,151 A * 11/1963 Bunting, Jr. et al. ..... 57/350
3,116,123 A * 12/1963 Sasnett ..... 34/527
3,116,410 A * 12/1963 La Manna et al. ..... 712/220
3,124,051 A * 3/1964 Buechner ..... 396/573
3,132,003 A * 5/1964 Pei et al. ..... 34/527
3,139,663 A * 7/1964 Boswell et al. ..... 425/253
3,149,373 A * 9/1964 Marzillier ..... 425/526
3,153,771 A * 10/1964 Anstey et al. ..... 367/53
3,154,780 A * 10/1964 Burbcck et al. ..... 342/125
3,162,032 A * 12/1964 Behrens ..... 68/18 F
3,169,838 A * 2/1965 Kripke ..... 34/528
3,174,490 A * 3/1965 Flarsheim ..... 134/80
3,176,444 A * 4/1965 Kiyonaga ..... 95/96
3,182,433 A * 5/1965 Beckham ..... 53/558
3,189,290 A * 6/1965 Welsh et al. ..... 242/331.5
3,197,618 A * 7/1965 Stanley et al. ..... 710/68
3,197,884 A * 8/1965 Smith ..... 34/532
3,197,896 A * 8/1965 Flelssner ..... 38/14
3,198,903 A * 8/1965 Chafee, Jr. ..... 335/152
3,200,511 A * 8/1965 Smith ..... 34/529
3,205,433 A * 9/1965 Lamb ..... 324/371
3,205,701 A * 9/1965 Szonntagh ..... 73/23.41
3,219,983 A * 11/1965 Hughes et al. ..... 365/126
3,221,417 A * 12/1965 Mellinger ..... 34/528
3,234,359 A * 2/1966 Hunt ..... 250/557
3,244,082 A * 4/1966 Lemelson ..... 228/18
3,268,380 A * 8/1966 Guichon et al. ..... 156/130
3,282,072 A * 11/1966 Neumann ..... 68/12.08
3,301,126 A * 1/1967 Wirley et al. ..... 399/16
3,302,452 A * 2/1967 Leslie ..... 73/64.43
3,303,628 A * 2/1967 Lovas et al. ..... 53/433
3,304,621 A * 2/1967 Nelson ..... 34/532
3,324,717 A * 6/1967 Brooks et al. ..... 73/152.45
3,338,053 A * 8/1967 Gorzegno et al. ..... 60/646
3,338,992 A * 8/1967 Kinney ..... 264/441
3,342,961 A * 9/1967 Deaton et al. ..... 337/36
3,354,774 A * 11/1967 Smitzer et al. ..... 355/27
3,355,346 A * 11/1967 Black et al. ..... 156/396
3,358,301 A * 12/1967 Candor et al. ..... 8/159
3,385,025 A * 5/1968 Lemelson ..... 53/453
3,388,567 A * 6/1968 Oles ..... 68/18 R
3,389,032 A * 6/1968 Black et al. ..... 156/111
3,476,562 A * 11/1969 Garland et al. ..... 430/344
3,531,954 A * 10/1970 Krupsky ..... 68/18 F
3,577,296 A * 5/1971 Phillips et al. ..... 156/249
3,613,254 A * 10/1971 Smith ..... 34/527
3,615,131 A * 10/1971 Sable et al. ..... 399/76
3,809,556 A * 5/1974 Pressman et al. ..... 430/53
3,826,690 A * 7/1974 Bleinberger et al. ..... 148/526
4,190,350 A * 2/1980 Donohue et al. ..... 399/86
4,215,931 A * 8/1980 Tsuda et al. ..... 399/18
4,763,425 A 8/1988 Grennan
5,673,497 A * 10/1997 St. Louis ..... 34/486
6,647,328 B2 * 11/2003 Walker ..... 701/36
6,687,339 B2 * 2/2004 Martin ..... 379/88.14
7,259,357 B2 * 8/2007 Walker ..... 219/243
7,565,084 B1 * 7/2009 Wach ..... 398/201
2001/0033639 A1 * 10/2001 Martin ..... 379/88.14
2001/0056544 A1 * 12/2001 Walker ..... 713/200
2003/0097764 A1 * 5/2003 St. Louis ..... 34/524
2004/0049324 A1 * 3/2004 Walker ..... 701/1
2004/0127355 A1 * 7/2004 Manu ..... 502/400
2006/0026017 A1 * 2/2006 Walker ..... 705/1
2006/0206246 A1 * 9/2006 Walker ..... 701/16
2008/0091309 A1 * 4/2008 Walker ..... 701/1
2008/0098615 A1 5/2008 Kim
2008/0261220 A1 * 10/2008 Cracauer et al. ..... 435/6
2010/0050464 A1 * 3/2010 Krzelowski et al. ..... 34/380
2011/0042900 A1 * 2/2011 Hutchinson et al. ..... 273/348.1

FOREIGN PATENT DOCUMENTS

DE 10 2007 046 069 A1 4/2008
DE 102007048249 A1 * 4/2008
EP 106646 A2 * 4/1984
EP 436375 A2 * 7/1991
EP 915199 A1 * 5/1999
EP 1449953 A1 * 8/2004
JP 54065872 A * 5/1979
JP 54156258 A * 12/1979
JP 63267957 A * 11/1988
JP 01153184 A * 6/1989
JP 02029231 A * 1/1990
JP 02109596 A * 4/1990
JP 02249584 A * 10/1990
JP 03085199 A * 4/1991
JP 03092199 A * 4/1991
JP 03094799 A * 4/1991
JP 03254795 A * 11/1991
JP 03267095 A * 11/1991
JP 03269981 A * 12/1991
JP 04200592 A * 7/1992
JP 05049799 A * 3/1993
JP 05131092 A * 5/1993
JP 06026976 A * 2/1994
JP 06304396 A * 11/1994
JP 07068095 A * 3/1995
JP 07265596 A * 10/1995
JP 08019685 A * 1/1996
JP 09019600 A * 1/1997
JP 10104897 A * 4/1998
JP 11057297 A * 3/1999
JP 11221914 A * 8/1999
JP 11244587 A * 9/1999
JP 2000051590 A * 2/2000
JP 2000140492 A * 5/2000
JP 2000237500 A * 9/2000
WO WO 47810 A1 * 8/2000

* cited by examiner

HEATING SYSTEM, DRYING MACHINE HAVING THE HEATING SYSTEM, AND METHOD OF CONTROLLING THE HEATING SYSTEM

CROSS-REFERENCE TO RELATED APPLICATIONS

The present application claims priority under 35 U.S.C. 119 and 35 U.S.C. 365 to Korean Patent Application No. 10-2006-098066, filed on Oct. 9, 2006, which is hereby incorporated by reference in its entirety.

BACKGROUND

The present disclosure relates to a heating system, a drying machine having the heating system, and a method of controlling the heating system.

Generally, a drying machine is an appliance that dries laundry. Heated air is supplied into the drying machine by a heating system. A heater may be applied as the heating system. The heater is turned on and off by a switch to maintain an internal space of a drum of the drying machine within a predetermined temperature range. That is, the heater is frequently turned on and off to dry the laundry at a proper temperature, thereby preventing the laundry from being damaged.

However, since the heater of the drying machine is frequently turned on and off by the switch, service life of the switch and the heater may be shortened. For example, when a filter of the drying machine is clogged by foreign objects such as nap, the internal space of the drum is overheated and thus the number of on/off times of the switch and heater increases steeply. This results in reducing the service life of the switch and heater.

SUMMARY

Embodiments provide a heating system and a method of controlling the heating system that can increase service life of a switch and a heater by reducing the number of on/off times of the heater and switch.

In one embodiment, a heating system includes a heating unit having a plurality of heaters for heating air flowing into a drum; switching units for turning on and off the respective heaters; and a control unit for turning on only some of the heaters when it is determined that the heating unit is turned on and off repeatedly by the predetermined number of times or more.

In another embodiment, a heating system includes a heating unit having high and low temperature heaters for heating air flowing into a drum; switching units for turning on and off the respective high and low temperature heaters; and a control unit for turning on only one of the high and low temperature heaters when it is determined that the heating unit is turned on and off repeatedly by the predetermined number of times or more.

In still another embodiment, a drying machine includes a drum in which laundry is loaded; an input unit for selecting an amount of the laundry and/or a kind of the laundry; a heating unit having a plurality of heaters for heating air flowing into a drum; switching units for turning on and off the respective heaters; and a control unit for turning on only some of the heaters when it is determined that the heating unit is turned on and off repeatedly by the predetermined number of times or more.

In still yet another embodiment, a method of controlling a heating system includes drying laundry as a heating unit having a plurality of heaters is turned on and off; determining the number of on/off times of the heating unit; and maintaining an on-state of only some of the heaters of the heating unit when it is determined that the heating unit is turned on and off repeatedly by the predetermined number of times or more.

In still yet another embodiment, a method of controlling a heating system includes drying laundry as a heating unit having high and low temperature heaters is turned on and off; determining the number of on/off times of the heating unit; and maintaining an on-state of only one of the heaters of the heating unit when it is determined that the heating unit is turned on and off repeatedly by the predetermined number of times or more.

In still yet further another embodiment, a method of controlling a heating system includes drying laundry as a heating unit having a plurality of heaters is turned on and off; determining the number of on/off times of the heating unit; and maintaining an on-state of only some of the heaters of the heating unit in accordance with an amount of the laundry and a kind of the laundry when it is determined that the heating unit is turned on and off repeatedly by the predetermined number of times or more.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

A heating system of an embodiment may be applied to a drying machine and a washing machine having a drying function. The drying machines (including the washing machine having the drying function) may be classified in a condensing type drying machine and an exhaust type drying machine. The condensing type drying machine dries laundry by close-circulating heated air. Therefore, the condensing type drying machine further includes a condensing unit for removing moisture by condensing humidity air. The exhaust type drying machine does not require the condensing unit as it is designed to exhaust humidity heated air to an external side. The following will describe a drying machine having a heating system of an embodiment.

Figure 1:
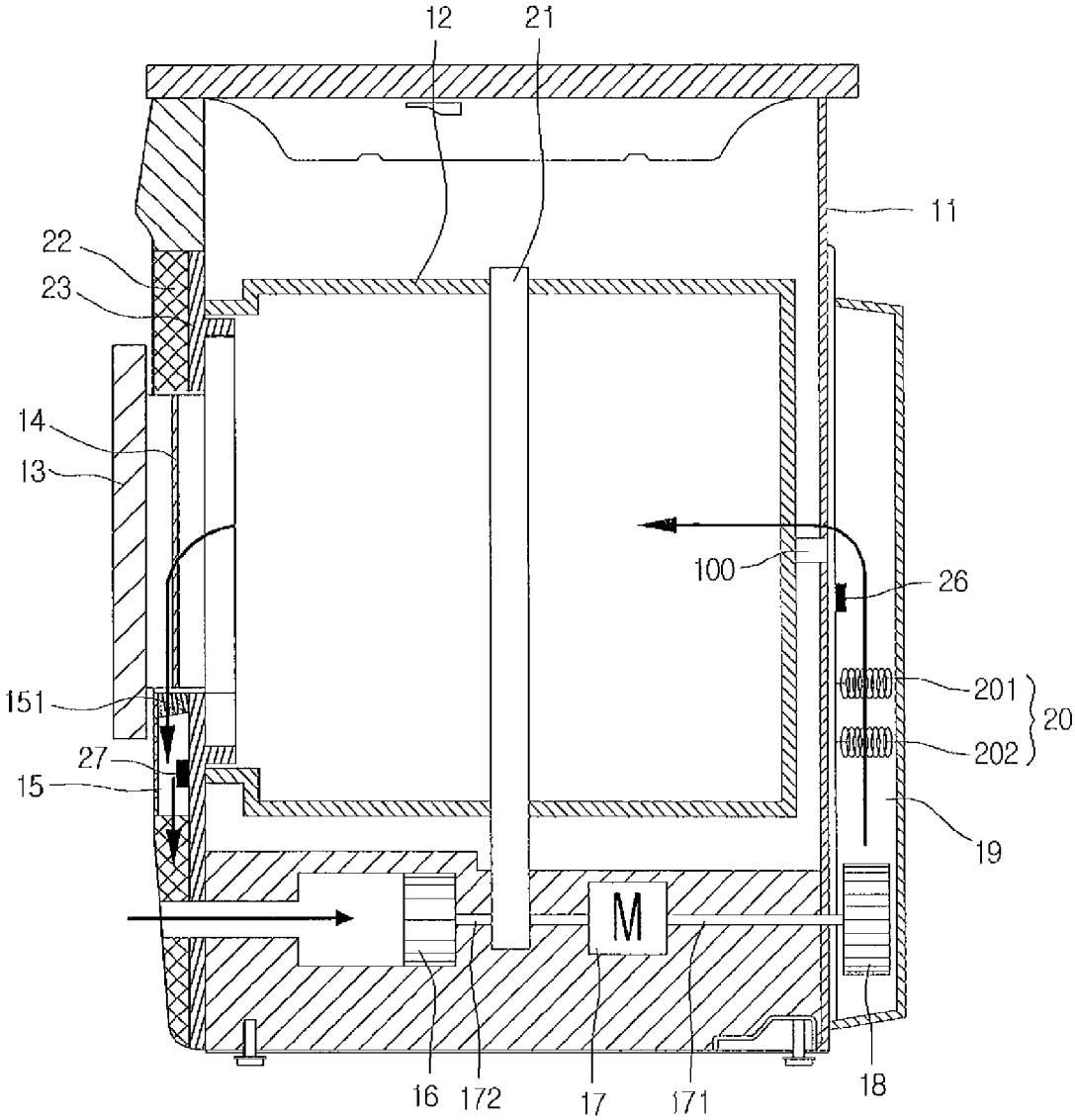
FIG. 1 is a sectional view of a drying machine having a heating system according to an embodiment.

FIG. 1 is a sectional view of a drying machine having a heating system according to an embodiment.

Referring to FIG. 1, the drying machine includes a cabinet 11 defining an outer appearance thereof. A front cover 23 is coupled to a front portion of the cabinet 11. A front frame is coupled to the front cover 23. A laundry loading inlet (not shown) is formed on the front cover 23 and front frame 22. A door 13 is pivotally installed on the laundry loading inlet.

A drum 12 is disposed in the cabinet 11 to be capable of rotating. A front portion of the drum 12 is supported by the front cover 23. A rear portion of the drum 12 is supported on the cabinet 11 by a rotational shaft 100. At least one bar-shaped lift may be disposed on an inner surface of the drum 12 to lift the laundry when the drum 12 rotates. The drum 12 rotates by a driving unit. The driving unit includes a belt 21 installed around an outer circumference of the drum 12 and a motor 17 rotating the belt 21. Alternatively, the driving unit may include only a motor that is directly connected to the rotational shaft of the drum 12.

The motor 17 has a first rotational shaft 172 to which a cooling fan 16 and the belt 21 are coupled and a second rotational shaft 171 to which a drying fan 18 is coupled. At this point, the belt 21 may be coupled to the first rotational shaft 172 by a pulley (not shown). The cooling fan 16 circulates internal air of the drum 12 and the drying fan 171 sucks air and directs the sucked air into the drum 12.

A drying duct 19 is connected to the rear portion of the drum 12. At this point, an air inlet (not shown) is formed in the rear portion of the drum 1. The drying duct 19 communicates with the internal space of the drum 12 through the air inlet (not shown). The drying fan 18 and a heating unit 20 may be disposed in the drying duct 19. The heating unit 20 may include at least two heaters 201 and 202. A temperature sensor 26 may be disposed in the drying duct 19 to measure a temperature of the air heated by the heating unit 20.

A circulation duct 15 connected to the laundry loading inlet (not shown) may be disposed on the front portion of the drum 12. A temperature sensor 27 for measuring a temperature of air discharged from the drum 12 may be disposed in the circulation duct 15.

A lint filter 151 for filtering off foreign objects such as nap contained in the air may be further disposed in the circulation duct 15. In addition, a lint filter 14 is further disposed on the door 13 to filter off the foreign objects such as nap contained in the humidity air discharged from the drum 12.

A condenser (not shown) may be disposed under the drum 12 to condense humidity air discharged from the circulation duct 15 through the heat exchange between the humidity air and room air that is separately introduced. Therefore, the air discharged from the drum 12 close-circulates along the circulation duct 15, the condenser (not shown), and the drying duct 19. In addition, the introduced room air is exhausted through the condenser to an external side. As described above, the moisture contained in the heated, humidity air is removed by the heat exchange between the heated, humidity air and the cool room air.

The following will describe operation of the above-described drying machine.

Referring again to FIG. 1, when electric power is applied to the drying machine, the motor 17 is driven, by which the belt 21 connected to the first rotational shaft 172 of the motor 17 rotates to rotate the drum 12. At this point, the laundry loaded in the drum 12 is lifted and falls.

In addition, the heating unit 20 disposed in the drying duct 19 operates. At this point, electric power is applied to all of the heaters 201 and 202 of the heating unit 20 so that all of the heaters 201 and 202 generate heat to heat the air circulating along the drying duct 19.

In addition, the drying fan 18 and the cooling fan 16 that are respectively connected to the second and first rotational shafts 171 and 172 of the motor 17 rotate, by which the air in the drying duct 19 is directed into the drum 12 after being heated by the heating unit 20. The laundry loaded in the drum 12 is heated by the heated air directed from the drying duct 19, by which the moisture contained in the laundry is vaporized and thus contained in the heated air.

The heated air containing the moisture is directed to the circulation duct 15. At this point, the foreign objects contained in the humidity air are filtered off by the lint filters 14 and 151. Subsequently, the humidity air flows along the circulation duct 15 and is recovered to the drying duct 19 via the condenser (not shown). At this point, the room air is directed to the condenser and subsequently discharged to the room. Therefore, the moisture contained in the humidity air is removed by the condenser.

Figure 2:
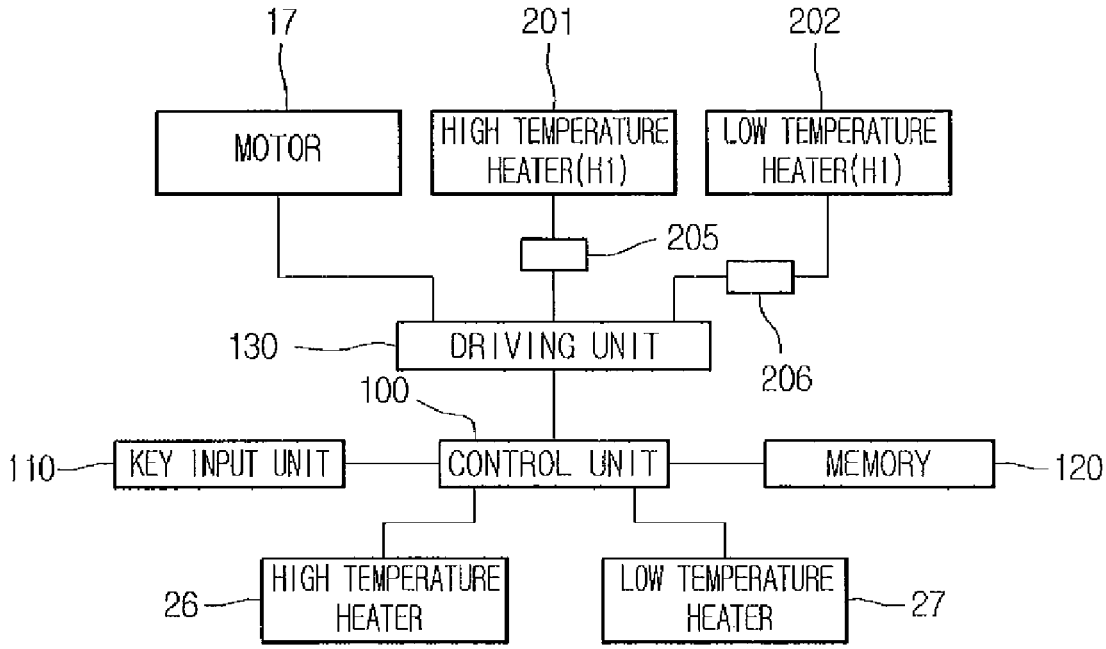
FIG. 2 is a block diagram of a heating system depicted in FIG. 1.

Meanwhile, the temperature sensor 26 disposed in the drying duct 19 and the temperature sensor 27 disposed in the circulation duct 15 transmit temperature information to a control unit 100 (see FIG. 2). The control unit 100 determines an internal temperature of the drum 12 in accordance with the temperature information from the temperature sensors 26 and 27. When it is determined that the internal temperature of the drum 12 reaches a predetermined upper limit value, the control unit 100 turns off all of the heaters 201 and 202 of the heating unit 20.

Even after the heaters 201 and 202 of the heating unit 20 are turned off, the temperature sensors 26 and 27 continues to detect the temperatures and transmits the temperature information to the control unit 100. When it is determined that the internal temperature of the drum 12 reaches a predetermined lower limit value, the control unit 100 turns on all of the heaters 201 and 202 of the heating unit 20 to increase the internal temperature of the drum 12.

As described above, as the heaters 201 and 202 of the heating unit 20 are turned on and off repeatedly, the internal temperature of the drum 12 is maintained within a predetermined temperature range, thereby reliably drying the laundry.

FIG. 2 is a block diagram of a heating system depicted in FIG. 1.

Referring to FIG. 2, a heating system includes the control unit 100. A key input unit 110 for inputting an operation command and/or drying condition of the drying machine is connected to the control unit 100. At this point, a user can input an amount of laundry to be dried and a kind of the laundry through the key input unit 110. Here, the amount of the laundry may be subdivided into a large volume mode, a medium volume mode, and a small volume mode. The kind of the laundry may be subdivided into a high temperature drying cloth mode, a medium temperature drying cloth mode, and a low temperature drying cloth mode.

The temperature sensors 26 and 27 for detecting temperatures of the air flowing along the drying duct 19 and the circulation duct 15 are connected to the control unit 100. A memory unit 120 for storing a variety of data and commands input from the key input unit 110 is connected to the control unit 100. A driving unit 130 for driving the drying machine in accordance with an input condition input through the key input unit 110 is electrically connected to the control unit 100. The motor 17 for rotating the drum 12 is electrically connected to the driving unit 130.

The heating unit 20 is electrically connected to the driving unit 120. The heating unit 20 includes the plurality of heaters 201 and 202 heating the air flowing into the drum 12. At this point, the heaters 201 and 202 may have different heat generation capacities or an identical heat generation capacity.

Switching units 205 and 206 for turning on and off the respective heaters may be disposed between the driving unit 120 and the heaters 201 and 202. Relays may be used as the switching units 205 and 206. Although only two heaters 201 and 202 are illustrated in FIG. 2, the present invention is not limited to this embodiment. That is, three or more heaters may be connected to the driving unit 120.

When it is determined that the heating unit 20 is turned on and off repeatedly by the predetermined number of times, the control unit 100 may turn on some of the heaters and turn off the rest.

At this point, the control unit 100 may turn on only the heater 202 having a relatively small heat generation capacity. For example, when the heating unit 20 has the heaters 201 and 202 having different heat generation capacities, the control unit 100 turns on the low temperature heater 202 having the relatively small heat generation capacity and turns off the high temperature heater 203 having the relatively large heat generation capacity.

Alternatively, the control unit 100 may turn on only the heater 203 having a relatively large heat generation capacity. For example, when the heating unit 20 has the heaters 201 and 202 having different heat generation capacities, the control unit 100 turns off the low temperature heater 202 having the relatively small heat generation capacity and turns on the high temperature heater 203 having the relatively large heat generation capacity.

Some of the heaters may be preset such that it is controlled to be turned on by the control unit 100 in accordance with the amount of the laundry or/and the kind of the laundry. For example, when it is determined that the heating unit 20 is turned on and off repeatedly by the predetermined number of times, the control unit 100 may turn on some of the heaters and turn off the rest. In addition, when the kind of the laundry is set as the low temperature drying cloth mode and it is determined that the heating unit 20 is turned on and off repeatedly by the predetermined number of times, the control unit 100 may turn on only the heater 202 having a relatively small heat generation capacity. In addition, even when the amount of the laundry is set as the large volume mode, the control unit 100 may turn on only the heater 202 having the relatively small heat generation capacity to prevent the damage of the laundry by the heat when the kind of the laundry is set as the lower temperature drying cloth mode.

The following will describe a method of controlling the heating system.

Figure 3:
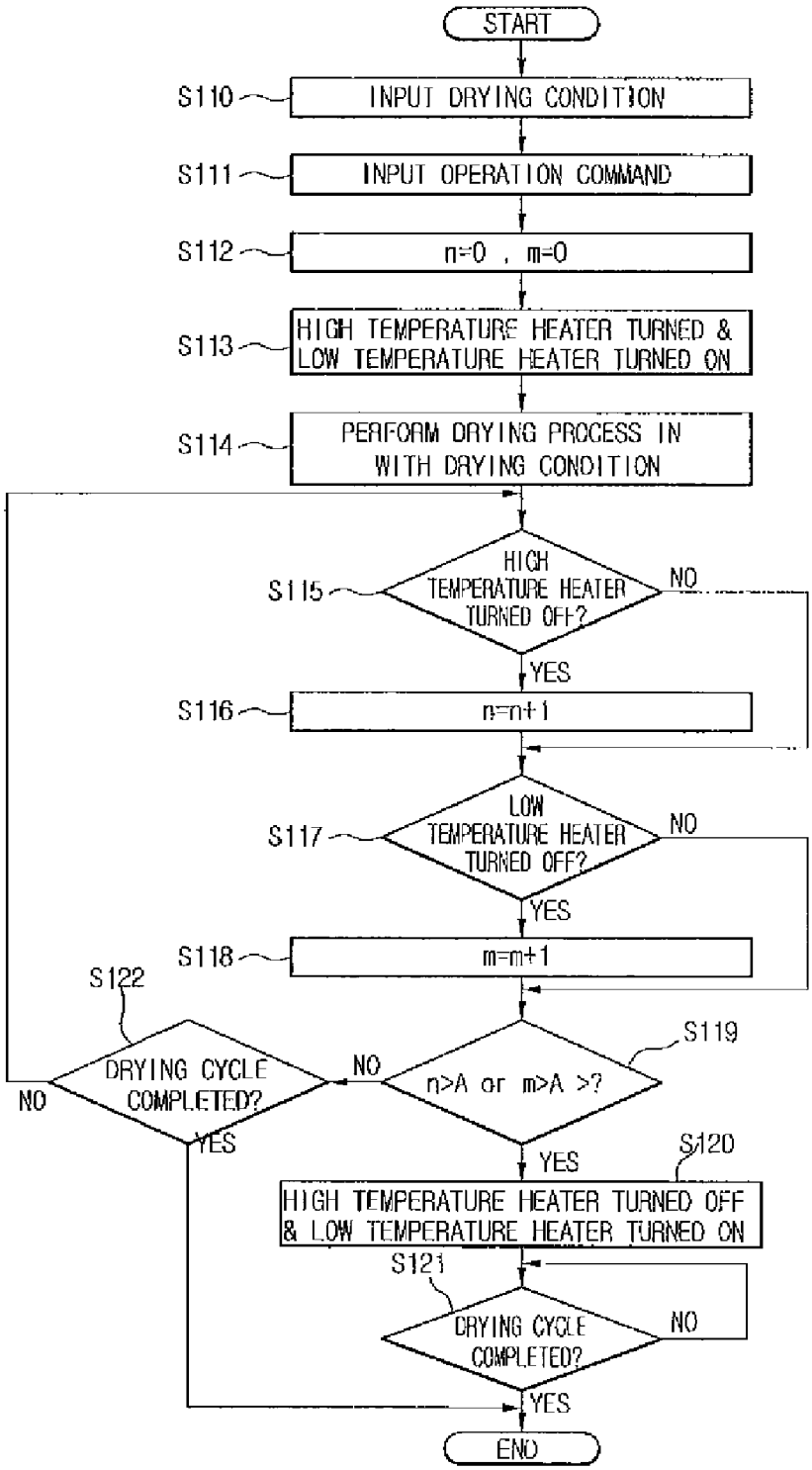
FIG. 3 is a flowchart illustrating a method of controlling a heating system according to an embodiment.

FIG. 3 is a flowchart illustrating a method of controlling a heating system according to an embodiment.

Referring to FIG. 3, the user inputs a drying condition through the key input unit 110 (S110). At this point, the user can selective a mode corresponding to the amount of the laundry and a mode corresponding to the kind of the laundry. Next, the user inputs an operation command using an operation button (S120).

When the operation command is input, the control unit 100 performs a reset operation to count the number of the on/off times of the heating unit 20. For example, when the heating unit 20 includes the two heaters 201 and 202 having different heat generation capacities, the control unit resets a count value n for counting the number of the on/off times of the high temperature heater 201 as 0 and resets a count value m for counting the number of the on/off times of the low temperature heater 202 as 0 (S112). Here, the numbers of the on/off times of the high and low temperature heaters 201 and 202 are identical to the numbers of the on/off times of the switching units 205,206.

In addition, all of the heaters 201 and 202 of the heating unit 20 are turned on in accordance with the drying condition input (S113) and the temperatures sensors 26 and 27 detect the internal temperature of the drum 12. The control unit 100 determines the internal temperature of the drum 12 in accordance with the temperature information from the temperature sensors 26 and 27 and turns on or off the heaters 201 and 202 of the heating unit 20. A drying process is performed while maintaining the internal temperature of the drum within a predetermined temperature range in accordance with the drying condition as described above (S114).

While the drying process is being performed, the control unit 100 counts the number of the on/off times of the heating unit 20. For example, the control unit 100 determines if there is a turning off of the high temperature heater 201 (S115). When it is determined that there is the turning off of the high temperature heater 201, the control unit 100 increases the count value n by 1 (S116). In addition, the control unit 100 determines if there is a turning off of the low temperature heater 202 (S117). When it is determined that there is the turning off of the low temperature heater 202, the control unit 100 increases the count value m by 1 (S118).

Further, when it is determined that the heating unit 20 is turned on and off repeatedly by the predetermined number or more, the control unit 100 turns on only the heater 202 of the heating unit 20. For example, the control unit 100 determines if at least one of the count values n and m reaches the predetermined number A (S119). When it is determined that at least one of the count values n and m reaches the predetermined number A, the high temperature heater 201 is controlled to be turned off and the low temperature heater 202 is controlled to be turned on.

Needless to say, it will be also possible that, When it is determined that at least one of the count values n and m reaches the predetermined number A, the high temperature heater 201 is controlled to be turned on and the low temperature heater 202 is controlled to be turned off.

It will be understood that the selection of the turning on of one of the high and low temperature heaters 201 and 202 of the heating unit 20 may be determined in accordance with the amount of the laundry and/or the kind of the laundry. When the amount of the laundry is set as the large capacity mode, the high temperature heater 201 is turned on while the low temperature heater 202 is turned off. When the amount of the laundry is set as the small capacity mode, the high temperature heater 201 is turned off while the low temperature heater 202 is turned on.

In this state, the drying process is continued. When the kind of the laundry is set as the high temperature drying cloth mode, the high temperature heater 201 is turned on while the low temperature heater 202 is turned off. When the kind of the laundry is set as the low temperature drying cloth mode, the high temperature heater 201 is turned off while the low temperature heater 202 is turned on.

Further, it is determined if the drying cycle is completed (S120). When it is determined that the drying cycle is being processed, the on-state of the low temperature heater 202 is maintained and the drying process is continued until the laundry is completely dried. When it is determined that the drying cycle is completed, the drying machine stops operating.

Meanwhile, when both of the counter values n and m do not reach the predetermined number A, it is determined if the drying cycle is completed (S122). At this point, when it is determined that the drying cycle is completed, the drying process is finished. On the contrary, when it is determined that the drying cycle is not completed, the drying process is continued in accordance with the input drying condition. That is, the processes following the process S114 are repeatedly performed. In this case, the on/off control of the high and low temperature heaters 201 and 202 is performed so that the internal temperature of the drum 12 is maintained within the predetermined temperature range in accordance with the input drying condition.

In addition, the predetermined number A may be 40 or more.

According to the above-described control method, the numbers of the on/off times of the heaters and switches can be reduced during a drying process. As a result, the service life of the switches increases, thereby reliably operating the drying machine.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heating system for a drying machine, the heating system comprising:

a heating unit having a plurality of heaters for heating air flowing into a drum;

a key input unit configured to input a drying condition of the drying machine, the drying condition including at least one of an amount of laundry and a kind of the laundry;

switching units for turning on and off the respective heaters; and a control unit for turning on only some of the heaters when it is determined that the heating unit is turned on and off repeatedly by predetermined number of times or more, wherein said some of the heaters configured to be maintained in the on-state are determined in accordance with at least one of the amount of the laundry and the kind of the laundry.

2. The heating system according to claim 1, wherein the heaters of the heating unit have different heat generation capacities and the heaters include a first heater and a second heater having a smaller heat generation capacity than that of the first heater.

3. The heating system according to claim 2, wherein the control unit turns on only the first heater according to an inputted condition through the key input when it is determined that at least one of the first and second heater is turned on and off repeatedly by the predetermined number of times or more, the inputted condition being one of that the amount of laundry is more than a predetermined amount or that the kind of the laundry is set as a high temperature drying cloth mode.

4. The heating system according to claim 2, wherein, when it is determined that the first and second heaters are turned on and off repeatedly by less than the predetermined number of times, the control unit maintains a predetermined temperature range while turning on and off repeatedly all of the heaters.

5. The heating system for a drying machine according to claim 2, wherein the control unit turns on only the second heater according to an inputted condition through the key input unit when it is determined that at least one of the first heater and second heater is turned on and off repeatedly by the predetermined number of times or more, the inputted condition being one of that the amount of the laundry is less than predetermined amount or that the kind of the laundry is set as a low temperature drying cloth mode.

* * * * *